US008683713B2

(12) United States Patent
Ha et al.

(10) Patent No.: US 8,683,713 B2
(45) Date of Patent: Apr. 1, 2014

(54) DRYER AND METHOD OF DETECTING VALUE OF DRYNESS

(75) Inventors: Ji Hoon Ha, Suwon-si (KR); Jeong Su Han, Suwon-si (KR); Jun hoe Choi, Suwon-si (KR); Sang Yeon Pyo, Suwon-si (KR); Tae Gyoon Noh, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 328 days.

(21) Appl. No.: 13/086,942

(22) Filed: Apr. 14, 2011

(65) Prior Publication Data

US 2011/0289796 A1 Dec. 1, 2011

(30) Foreign Application Priority Data

Jun. 1, 2010 (KR) ..... 10-2010-0052000

(51) Int. Cl.
*F26B 25/06* (2006.01)

(52) U.S. Cl.
USPC ..... 34/381; 34/413; 34/606; 34/610; 68/18 R; 68/19; 8/159; 62/291

(58) Field of Classification Search
USPC ..... 34/595, 601, 606, 610, 381, 413, 468, 34/497; 68/18 R, 19, 12.09; 8/137, 158, 8/159; 62/93, 291
See application file for complete search history.

(56) References Cited

U.S. PATENT DOCUMENTS

| | | | | | |
|---|---|---|---|---|---|
| 3,196,553 | A | * | 7/1965 | Deaton et al. | 34/534 |
| 3,222,896 | A | * | 12/1965 | Schneider | 68/12.09 |
| 3,258,847 | A | * | 7/1966 | Schneider | 34/543 |
| 4,127,947 | A | * | 12/1978 | Webb et al. | 34/92 |
| 4,250,628 | A | * | 2/1981 | Smith et al. | 34/260 |
| 4,952,339 | A | * | 8/1990 | Temus et al. | 588/20 |
| 5,335,425 | A | * | 8/1994 | Tomizawa et al. | 34/265 |
| 7,036,243 | B2 | * | 5/2006 | Doh et al. | 34/595 |
| 7,926,311 | B2 | * | 4/2011 | Mani et al. | 68/19 |
| 2002/0029580 | A1 | * | 3/2002 | Faqih | 62/291 |
| 2005/0071929 | A1 | * | 4/2005 | Mani et al. | 8/158 |
| 2005/0132593 | A1 | * | 6/2005 | Doh et al. | 34/73 |
| 2005/0132599 | A1 | * | 6/2005 | Lee et al. | 34/549 |
| 2006/0225298 | A1 | * | 10/2006 | Konabe et al. | 34/77 |

(Continued)

FOREIGN PATENT DOCUMENTS

| | | | | | |
|---|---|---|---|---|---|
| EP | 1 600 549 | A2 | | 11/2005 | |
| EP | 1 734 170 | A1 | | 12/2006 | |
| FR | 2790688 | A1 | * | 9/2000 | B08B 3/04 |
| JP | 09004978 | A | * | 1/1997 | F26B 25/00 |
| JP | 11186211 | A | * | 7/1999 | H01L 21/304 |
| JP | 2008099981 | A | * | 5/2008 | |

(Continued)

OTHER PUBLICATIONS

European Search Report dated Sep. 6, 2011 issued in correspondence with European Patent Application 11163826.8.

*Primary Examiner* — Steve M Gravini
(74) *Attorney, Agent, or Firm* — Staas & Halsey LLP

(57) ABSTRACT

Disclosed herein are a dryer and a drying method of the same. The dryer includes a condensing unit to change water vapor evaporated from a drying object into condensate water by cooling, a condensate water storage container in which the condensate water is stored, a water level sensing device to detect a level of the stored condensate water, and a micro-computer to calculate a change rate of condensation or of the condensate water level based on the detected water level and to determine a value of dryness of the drying object. The dryer effectively performs a drying operation based on the accurately detected value of dryness of the drying object.

19 Claims, 13 Drawing Sheets

(56) References Cited

U.S. PATENT DOCUMENTS

| | | | | |
|---|---|---|---|---|
| 2010/0154248 | A1* | 6/2010 | Stolze | 34/493 |
| 2011/0047813 | A1* | 3/2011 | Kuhl et al. | 34/468 |
| 2011/0214535 | A1* | 9/2011 | Vandor | 75/392 |
| 2011/0289796 | A1* | 12/2011 | Ha et al. | 34/468 |
| 2012/0304488 | A1* | 12/2012 | Pardo | 34/514 |
| 2013/0032298 | A1* | 2/2013 | Putt et al. | 159/23 |

FOREIGN PATENT DOCUMENTS

| | | | | |
|---|---|---|---|---|
| JP | 2008-307416 | A | 12/2008 | |
| KR | 10-2006-0085790 | | 7/2006 | |
| KR | 10-2009-0024586 | | 3/2009 | |
| WO | WO 9507124 | A1 * | 3/1995 | B01D 3/10 |
| WO | WO 2010065842 | A2 * | 6/2010 | G01F 23/68 |

* cited by examiner

DRYER AND METHOD OF DETECTING VALUE OF DRYNESS

CROSS-REFERENCE TO RELATED APPLICATIONS

This application claims the priority benefit of Korean Patent Application No. 2010-0052000, filed on Jun. 1, 2010 in the Korean Intellectual Property Office, the disclosure of which is incorporated herein by reference.

BACKGROUND

1. Field

Embodiments relate to a dryer and a control method of the same, which may detect the value of dryness of a drying object by detecting the change rate of condensate water.

2. Description of the Related Art

A dryer serves to dry an object received in a drying tub by blowing hot air into the drying tub. Generally, dryers may be broadly classified into an exhaust type dryer and a condensing type dryer according to whether or not air used for drying undergoes a condensing process. In the exhaust type dryer, high-temperature humid air having passed through the drying tub is directly exhausted out of the dryer. In the condensing type dryer, after removing moisture from the high-temperature humid air, the resulting high-temperature air is recirculated into the drying tub.

The condensing type dryer includes a condensing unit for removal of moisture. The high-temperature humid air is condensed while passing through the condensing unit through which cold air passes, and water vapor is changed into condensate water. The condensate water may be stored in a collector or storage container, and may be manually or automatically removed.

In a conventional dryer, a water level sensing device mounted in a condensate water storage container functions only to detect whether the storage container is full of condensate water, to allow the condensate water to be discharged to the outside or to be moved into another storage container, or to stop movement of the condensate water.

Conventionally, the value of dryness of a drying object has been detected using a humidity sensor, temperature sensor or electrode sensor. These sensors, however, may have difficulty detecting the value of dryness due to a fixed position thereof. In particular, the electrode sensor may misjudge completion of drying despite when only a surface of a thick object is dried.

SUMMARY

Therefore, it is one aspect to provide a dryer and a control method of the same, in which a water level sensing device located in a condensate water storage container functions to detect the change rate of condensation of condensate water and consequently, to detect the value of dryness of a drying object.

It is another aspect to provide a dryer and a control method of the same, in which a contact area between a water level sensing device and condensate water is greater at a high water level than at a low water level of a condensate water storage container.

It is another aspect to provide a dryer and a control method of the same, in which the change rate of condensate water per unit amount of condensate water is greater at a high water level than at a low water level of a condensate water storage container.

It is a further aspect to provide a dryer and a control method of the same, in which a water level sensing device located in a condensate water collector functions to detect the change rate of condensate water and consequently, to detect the value of dryness of a drying object.

Additional aspects will be set forth in part in the description which follows and, in part, will be obvious from the description, or may be learned by practice of the embodiment.

In accordance with one aspect, a dryer includes a condensing unit to change water vapor evaporated from a drying object into condensate water by cooling, a condensate water storage container in which the condensate water is stored, a water level sensing device to detect a level of the stored condensate water, and a controller to calculate a change rate of the condensate water based on the detected water level and to determine a value of dryness of the drying object.

In accordance with another aspect, a dryer includes a condensing unit to change water vapor evaporated from a drying object into condensate water by cooling, a condensate water collector in which the condensate water is collected, a condensate water storage container in which the condensate water is stored, a pump to move the condensate water collected in the condensate water collector to the condensate water storage container, a water level sensing device to detect a level of the condensate water in the condensate water collector, and a controller to calculate a change rate of the condensate water based on the detected water level and to determine a value of dryness of the drying object. A contact area between the plurality of electrodes and the condensate water may increase from the bottom to the top of the condensate water collector.

In accordance with another aspect, a dryer includes a condensing unit to change water vapor evaporated from a drying object into condensate water by cooling, a condensate water storage container having a longitudinal cross sectional width decreasing from the bottom to the top thereof, a water level sensing device to detect a level of the condensate water in the condensate water storage container, and a controller to calculate a change rate of the condensate water based on the detected water level and to determine a value of dryness of the drying object.

In accordance with a further aspect, a dryer includes a condensing unit to change water vapor evaporated from a drying object into condensate water by cooling, a condensate water collector in which condensate water is stored, a pump to move the condensate water collected in the condensate water collector, a condensate water storage container to store the condensate water moved from the condensate water collector by the pump, a water level sensing device to detect a level of the condensate water in the condensate water collector, and a controller to calculate a change rate of the condensate water based on the detected water level and to determine a value of dryness of the drying object.

BRIEF DESCRIPTION OF THE DRAWINGS

These and/or other aspects of the embodiments will become apparent and more readily appreciated from the following description of the embodiments, taken in conjunction with the accompanying drawings of which.

DETAILED DESCRIPTION

Figure 1:
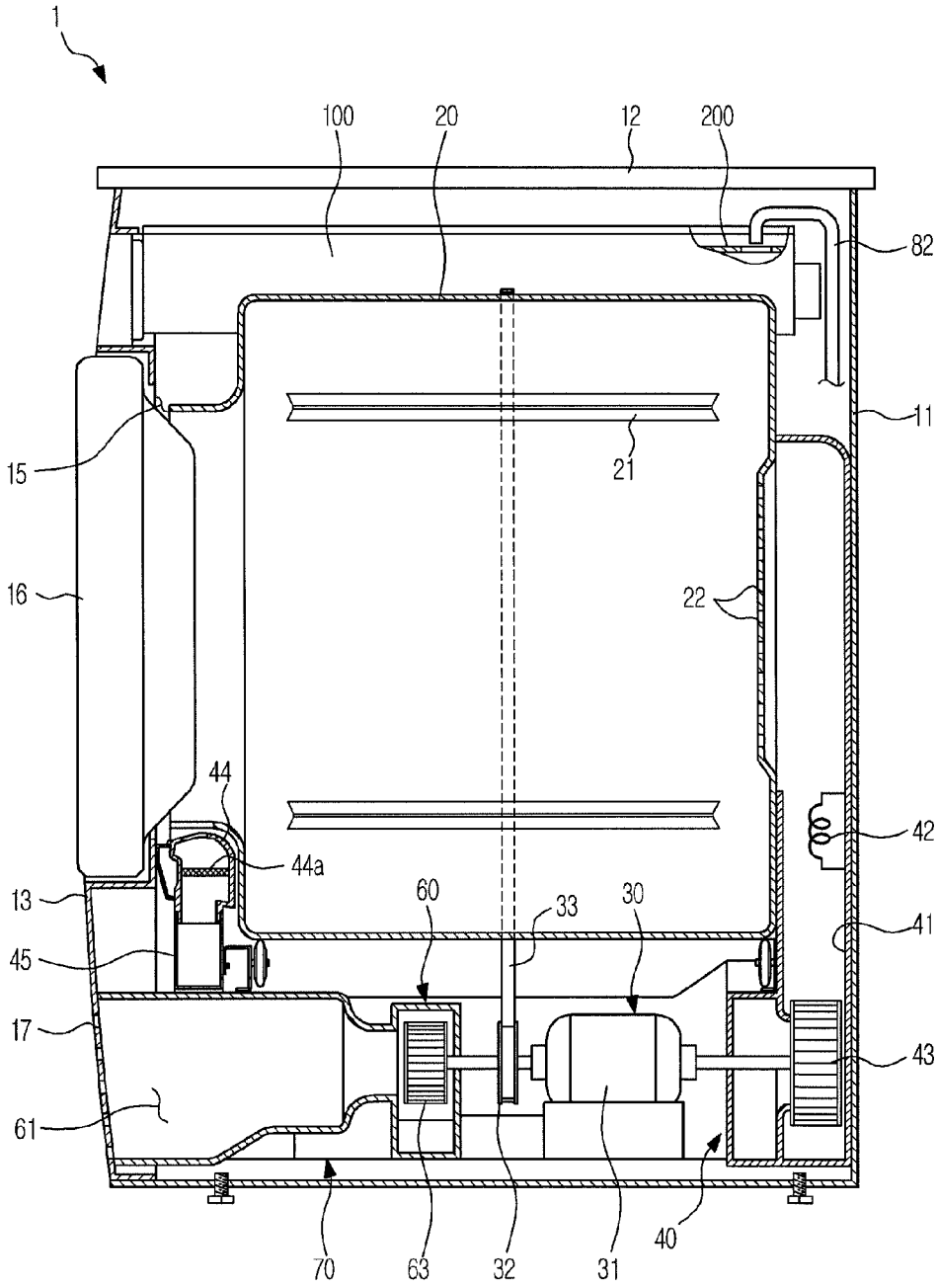
FIG. 1 is a sectional view illustrating the interior configuration of a dryer in accordance with an embodiment.

Reference will now be made in detail to the embodiments, examples of which are illustrated in the accompanying drawings, wherein like reference numerals refer to like elements throughout.

Figure 2:
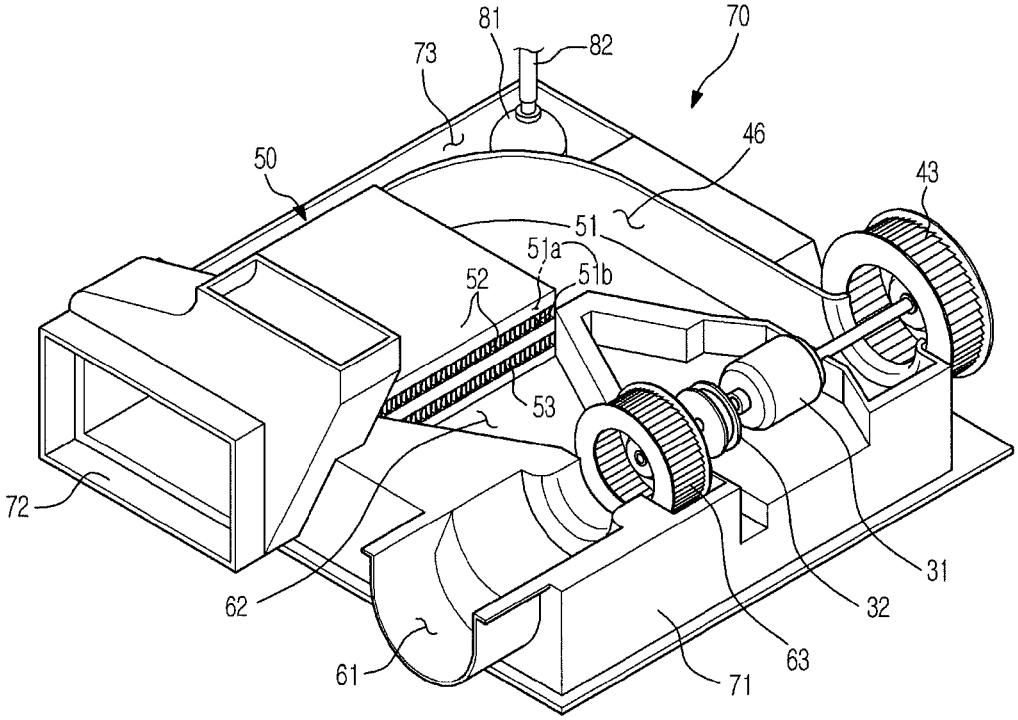
FIG. 2 is a perspective view illustrating a base assembly of the dryer in accordance with the embodiment.

FIG. 1 is a sectional view illustrating the configuration of a dryer in accordance with the embodiment, and FIG. 2 is a perspective view illustrating a base assembly of the dryer in accordance with the embodiment.

As illustrated in FIGS. 1 and 2, the dryer 1 in accordance with the embodiment includes a main body 10, rotary drum 20, drive unit 30, drying unit 40, base assembly 70, cooling unit 60 and condensate water storage container 200.

The main body 10 is provided at a front surface thereof with an input opening 15, through which a drying object is input into the rotary drum 20. A door 16 is hingedly coupled in front of the opening 15 to open or close the opening 15.

The rotary drum 20 is rotatably installed in the main body 10. The rotary drum 20 has a plurality of lifers 21 circumferentially arranged at an inner surface thereof. The lifters 21 repeatedly raise and drop the drying object, enabling effective drying of the drying object.

The rotary drum 20 has an open front side, and is provided at a rear wall thereof with a hot air inlet grill 22 to allow air heated by the drying unit 40 to be introduced into the rotary drum 20 through the hot air inlet grill 22.

A base assembly 70 is mounted below the rotary drum 20. The base assembly 70 includes a base 71, in which flow-paths 46, 61 and 62 are defined, and at least one cover (not shown) to cover the base 71 from the upper side thereof. The cover is configured to cover a condensing unit 50, cooling fan 63 and flow-paths 46, 61 and 62, and constructs a duct structure along with the base 71.

The rotary drum 20 is driven by the drive unit 30. The drive unit 30 includes a drive motor 31 mounted in the base assembly 70, a pulley 32 to be rotated by the drive motor 31, and a belt 33 that connects the pulley 32 and the rotary drum 20 to each other to transmit power of the drive motor 31 to the rotary drum 20.

The drying unit 40 serves to dry the drying object inside the rotary drum 20 by heating air and circulating the heated air. The drying unit 40 may include a heating duct 41, heater 42, circulating fan 43, hot air discharge duct 44, connecting duct 45 and hot air circulating flow-path 46.

The heating duct 41 is located at the rear side of the rotary drum 20 and communicates with the interior of the rotary drum 20 through the hot air inlet grill 22 provided at the rotary drum 20. The heating duct 41 also communicates with the hot air circuiting flow-path 46.

The heater 42 and circulating fan 43 are arranged in the heating duct 41. The heater 42 serves to heat air. The circulating fan 43 generates an air stream circulating through the rotary drum 20 by suctioning air from the hot air circulating flow-path 46 and discharging the suctioned air into the heating duct 41. The circulating fan 43 may be driven by the drive motor 31 while the drive motor 31 is operated to drive the rotary drum 20.

The hot air discharge duct 44 is located at the front side of the rotary drum 20 and serves to guide discharge of high-temperature humid air having passed through the interior of the rotary drum 20. The hot air discharge duct 44 is provided with a filter 44*a* to capture impurities.

To circulate hot air, the connecting duct 45 is used to connect the hot air discharge duct 44 and the hot air circulating flow-path 46 to each other, and the hot air circulating flow-path 46 is used to connect the connecting duct 45 and the heating duct 41 to each other. The connecting duct 45 and hot air circulating flow-path 46 may be integrated with the base assembly 70.

The condensing unit 50 is arranged in the hot air circulating path 46 and serves to remove moisture from the circulating hot air. As the hot air is cooled by relatively cold air supplied from the cooling unit 60 while passing through the condensing unit 50, moisture contained in the circulating hot air is condensed.

The cooling unit 60 includes the intake flow-path 61, exhaust flow-path 62 and cooling fan 63. One end of the intake flow-path 61 is connected to an intake grill 17 formed at a lower position of the front surface of the main body 10. The other end of the intake flow-path 61 is connected to a suction side of the cooling fan 63. Also, one end of the exhaust flow-path 62 is connected to a discharge side of the cooling fan 63. The exhaust flow-path 62 extends toward the hot air circulating flow-path 46, and the condensing unit 50 is located at the junction of the exhaust flow-path 62 and the hot air circulating flow-path 46. The intake flow-path 61 and exhaust flow-path 62 may be integrated with the base assembly 70.

The condensing unit 50 undergoes heat exchange between the hot air circulating through the hot air circulating flow-path 46 of the drying unit 40 and the cold air moving through the exhaust flow-path 62 of the cooling unit 60 in a state in which the hot air and the cold air are isolated from each other. To this end, the condensing unit 50 includes a plurality of partitions 52 stacked one above another by a predetermined distance to define heat-exchange flow-paths 51.

The heat-exchange flow-paths 51 include condensing flow-paths 51*a* and cooling flow-paths 51*b*. The condensing flow-paths 51*a* communicate with the connecting duct 45 and the hot air circulating flow-path 46 for passage of the circulating hot air. The cooling flow-paths 51*b* communicate with the exhaust flow-path 62 for passage of the cold air. The condensing flow-paths 51*a* and cooling flow-paths 51*b* are isolated from each other and are alternately arranged to intersect with each other. The cooling flow-path 51*b* may be provided with fins 53 to improve heat-exchange efficiency of the condensing unit 50.

The exhaust flow-path 62 for exhaust of the heat-exchanged air extends toward the hot air circulating flow-path 46. The condensing unit 50 is located at the junction of the exhaust flow-path 62 and the hot air circulating flow-path 46. The intake flow-path 61 and exhaust flow-path 62 may be integrated with the base assembly 70.

The condensing unit 50 may be inserted into or separated from the base assembly 70 through a condensing unit input opening 72 located at a front position of the base assembly 70.

Figure 3:
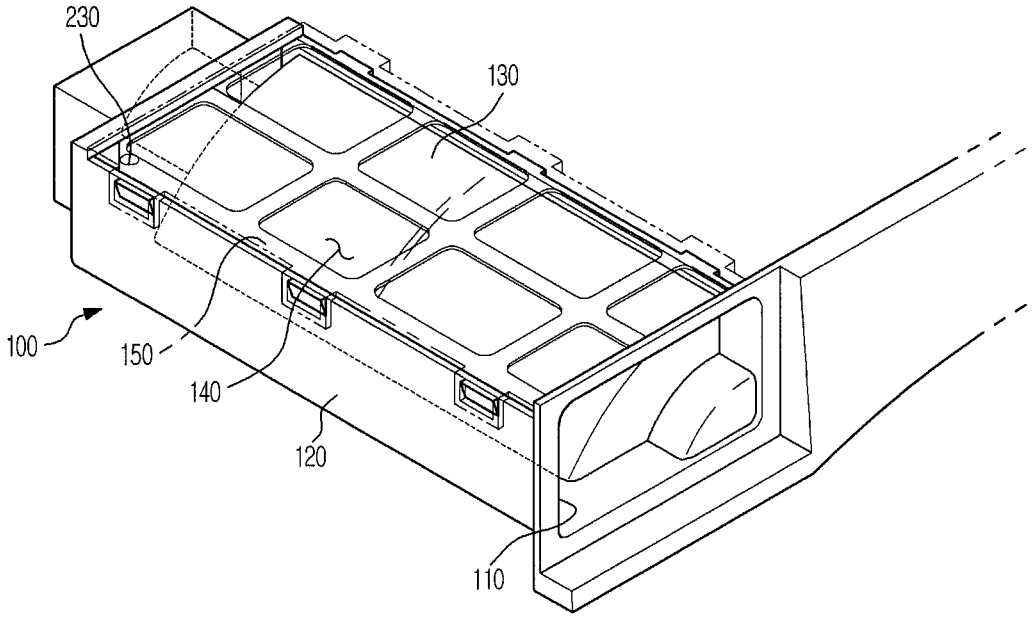
FIG. 3 is a perspective view illustrating a condensate water storage container housing of the dryer in accordance with the embodiment.

FIG. 3 is a perspective view illustrating a condensate water storage container housing of the dryer in accordance with the embodiment.

A housing 100 for the condensate water storage container 200 includes a housing entrance 110 for entrance/exit of the condensate water storage container 200, and a receiving space 140 in which the condensate water storage container 200 is received. The receiving space 140 is defined by two sidewall plates 120 and a bottom plate 130 of the housing 100. The top of the receiving space 140 may be defined by a protective panel 150 that is used to protect the condensate water storage container 200. The bottom plate 130 of the housing 100 may be partially curved to prevent interference between the housing 100 and the rotary drum 20 located below the housing 100.

The condensate water storage container 200 has a condensate water entrance/exit aperture 230 formed in a lateral position of an upper surface thereof. One end of a condensate water discharge pipe (82, see FIG. 2) is located above the condensate water entrance/exit aperture 230. The condensate water guided through the condensate water discharge pipe 82 drops from the pipe 82 to the condensate water entrance/exit aperture 230, thereby being introduced into the condensate water storage container 200. Upon completion of a drying stroke or operation, or when the condensate water storage container 200 is filled with the condensate water beyond a predetermined level, the condensate water storage container 200 is manually or automatically separated and the condensate water filled therein is discharged through the condensate water entrance/exit aperture 230.

Figure 4:
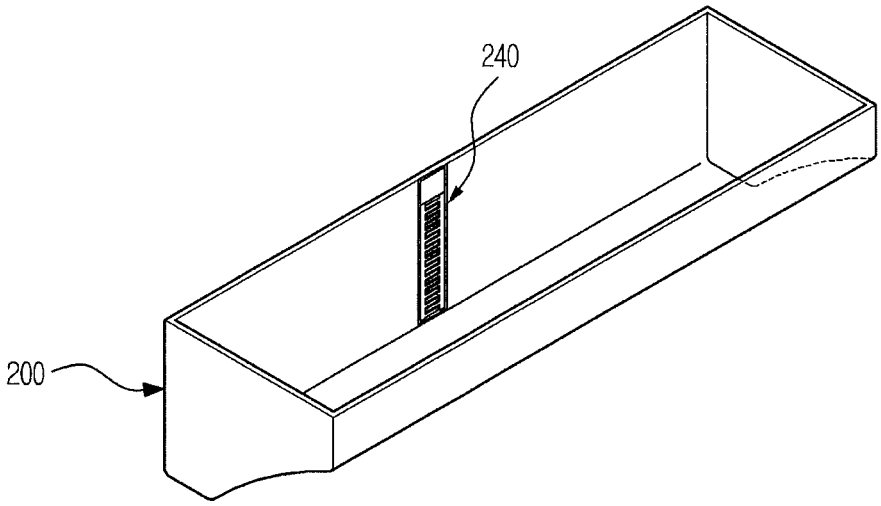
FIG. 4 is a perspective view illustrating a water level sensing device provided in the condensate water storage container of the dryer in accordance with one embodiment.

FIG. 4 is a perspective view illustrating a water level sensing device provided in the condensate water storage container of the dryer in accordance with one embodiment. Hereinafter, the water level sensing device will be described with reference to the block diagram of FIG. 9 as well as FIG. 4.

If the level of condensate water in the condensate water storage container 200 rises via introduction of the condensate water, the water level sensing device 240 detects the water level. The water level sensing device 240 may be attached to an inner surface of the condensate water storage container 200. Specifically, one or more water level sensing devices 240 may be attached to certain positions that exhibit the change of water level. FIG. 4 illustrates the water level sensing device 240 in accordance with one embodiment as being located at a side surface of the condensate water storage container 200. The water level sensing device 240 detects the level of condensate water, and transmits the detected value to a controller 600, such as a microcomputer. The level value of condensate water detected by the water level sensing device 240 is used to determine the change rate of condensate water and consequently, to determine the value of dryness of the drying object based on the change rate of condensate water.

The water level sensing device 240, as illustrated in FIG. 4, may be a level sensor. Of course, any other devices may serve as the water level sensing device 240 so long as they may detect the level of condensate water. For example, the water level sensing device 240 may be a pressure sensor, weight sensor, float sensor, or the like.

Figure 5A:
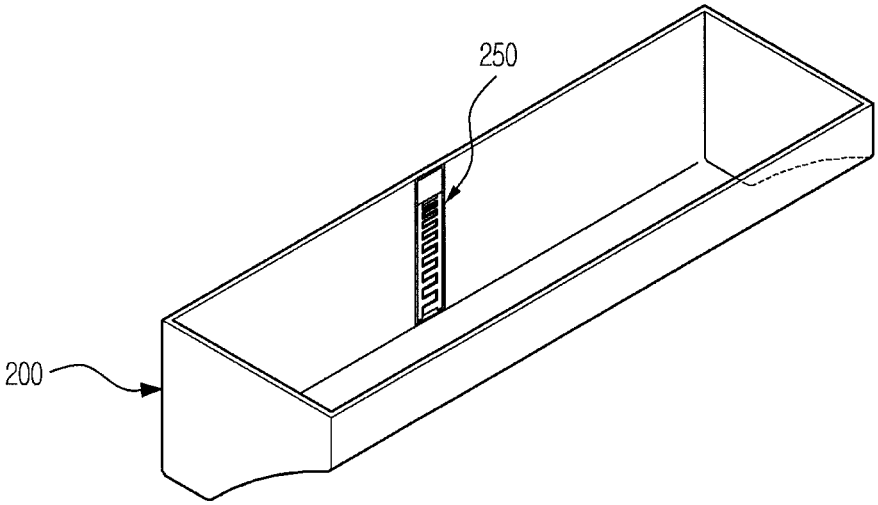
FIG. 5A is a perspective view illustrating a water level sensing device provided in the condensate water storage container of the dryer in accordance with another embodiment.

FIG. 5A is a perspective view illustrating a water level sensing device provided in the condensate water storage container in accordance with another embodiment.

If the level of condensate water in the condensate water storage container 200 rises via introduction of the condensate water, the water level sensing device 250 detects the water level. The water level sensing device 250 may be attached to the inner surface of the condensate water storage container 200. Specifically, one or more water level sensing devices 250 may be attached to certain positions that exhibit the change of water level.

Figure 5B:
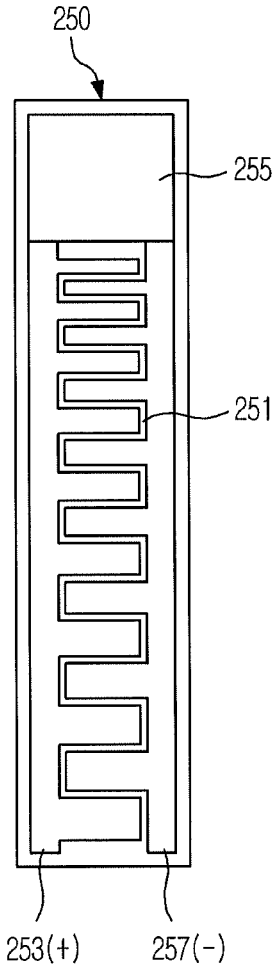
FIG. 5B is a front view of the water level sensing device illustrated in FIG. 5A.

FIG. 5B is an enlarged view illustrating the water-level sensing device of FIG. 5A.

The water level sensing device 250 includes two electrodes 253 and 257 having opposite polarities. The two electrodes 253 and 257 are arranged close to each other, and facing surfaces of the two electrodes 253 and 257 are toothed to engage with each other. When viewing the teeth of the two electrodes 253 and 257 on the basis of a circuit part 255, a vertical size of each tooth corresponds to a length and a horizontal size of the teeth corresponds to a width.

The circuit part 255 connected to the two electrodes 253 and 257 applies voltage to the electrodes, and senses a voltage change based on a capacitance change depending on the amount or state of dielectrics. The circuit part 255 may be located at a surface of the water level sensing device 250, to output electric signals representing the voltage change of the electrodes 253 and 257.

The water level sensing device 250 includes a toothed dielectric passage 251 having a constant width. A contact area between the dielectric passage 251 and dielectrics increase from the bottom to the top of the storage container 200. To this end, the teeth of the toothed dielectric passage 251 have a constant width, whereas the length of the teeth decreases from the bottom to the top of the water level sensing device 250 on the basis of the circuit part 255. Similarly, the length of the teeth of the two electrodes 253 and 257 may decrease from the bottom to the top of the water level sensing device 250 on the basis of the circuit part 255.

Figure 6A:
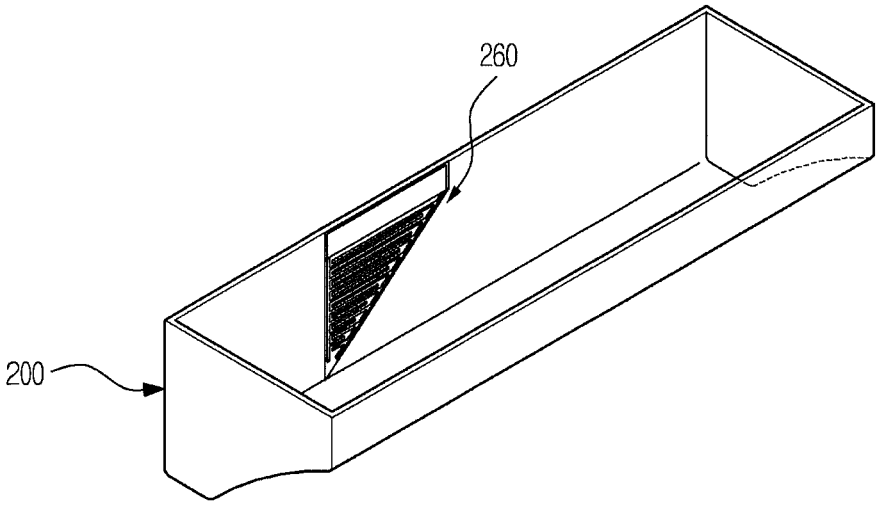
FIG. 6A is a perspective view illustrating a water level sensing device provided in the condensate water storage container of the dryer in accordance with another embodiment.

FIG. 6A is a perspective view illustrating a water level sensing device provided in the condensate water storage container in accordance with another embodiment.

If the level of condensate water in the condensate water storage container 200 rises via introduction of the condensate water, the water level sensing device 260 detects the water level. The water level sensing device 260 may be attached to the inner surface of the condensate water storage container 200. Specifically, one or more water level sensing devices 260 may be attached to certain positions where exhibit the change of water level.

Figure 6B:
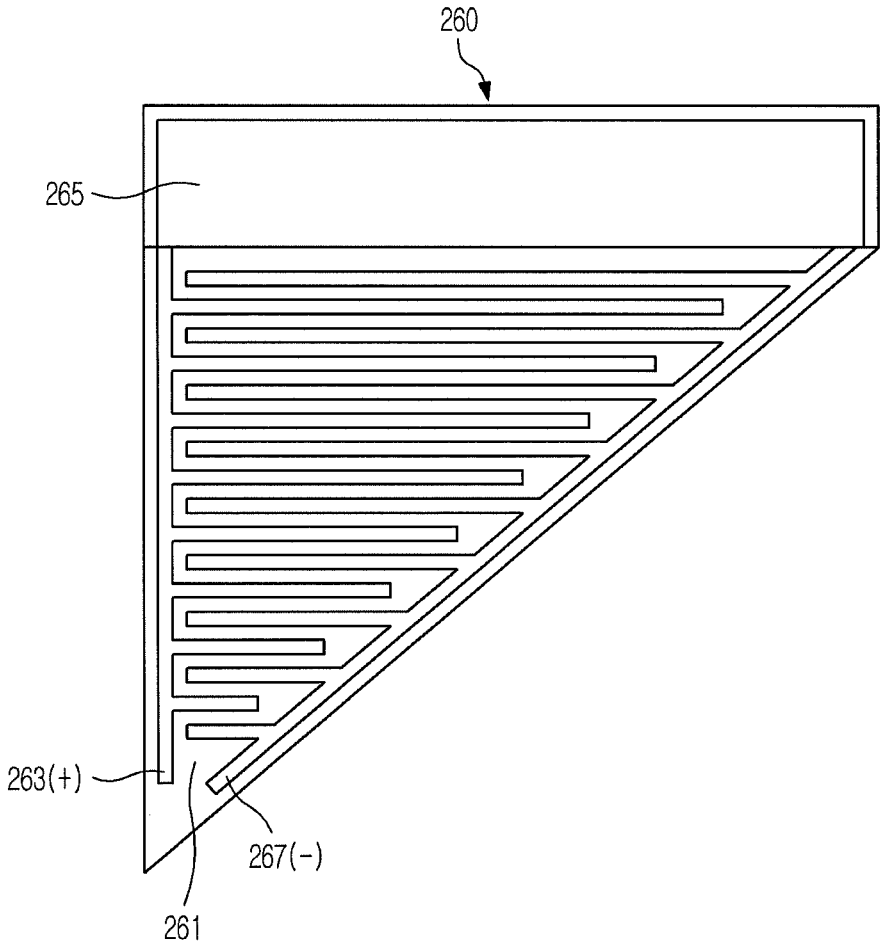
FIG. 6B is a front view of the water level sensing device illustrated in FIG. 6A.

FIG. 6B is a front view illustrating the water level sensing device of FIG. 6A.

The water level sensing device 260 includes two electrodes 263 and 267 having opposite polarities. The two electrodes 263 and 267 are arranged close to each other, and facing surfaces of the two electrodes 263 and 267 are toothed to engage with each other. The teeth of the two electrodes 263 and 267 have a constant length, whereas the width of the teeth increases from the bottom to the top of the water level sensing device 260 on the basis of a circuit part 265. That is, the width of the teeth of the two electrodes 263 and 267 may increase proportionally to the water level.

Figure 7:
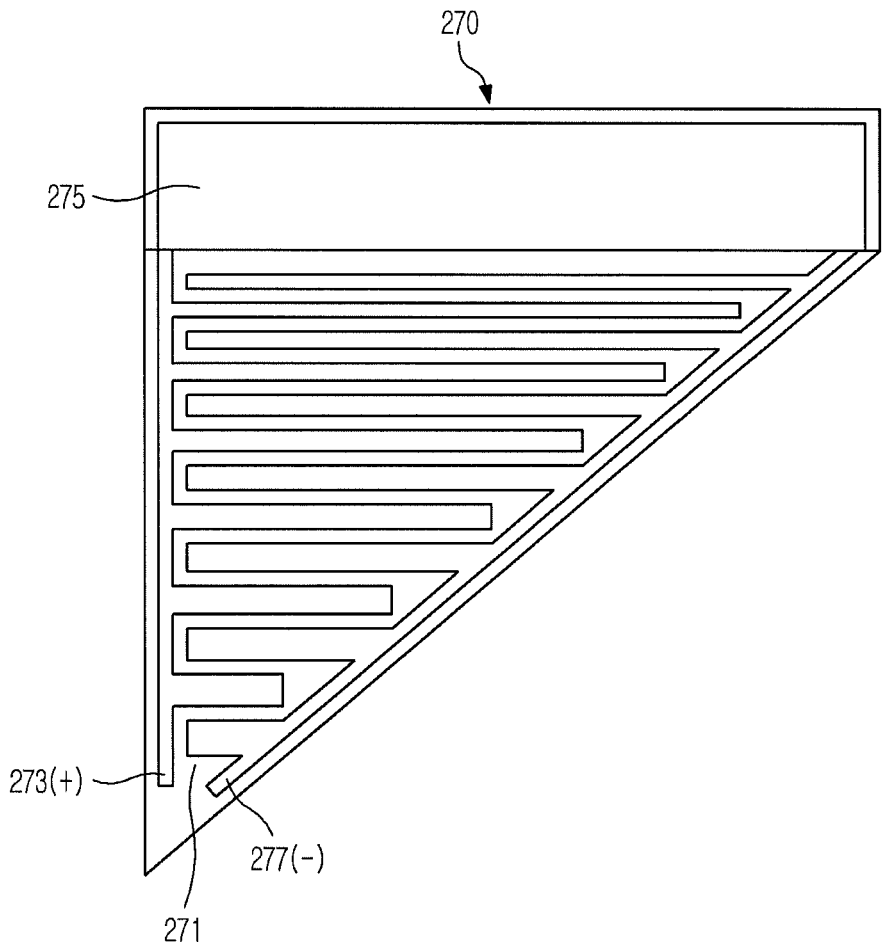
FIG. 7 is a front view illustrating a water level sensing device of the dryer in accordance with a further embodiment.

FIG. 7 is a front view illustrating a water level sensing device of the drier in accordance with a further embodiment.

In accordance with the present embodiment, the water level sensing device 270 of the dryer 1 may include both the configuration of the water level sensing device 250 of FIG. 5B and the configuration of the water level sensing device 260 of FIG. 6B. The water level sensing device 270 includes two electrodes 273 and 277 having opposite polarities. The two electrodes 273 and 277 are arranged close to each other, and facing surfaces of the two electrodes 263 and 267 are toothed to engage with each other. The water level sensing device 270 includes a toothed dielectric passage 271 having a constant width. A contact area between the dielectric passage 271 and dielectrics increases from the bottom to the top of the water level sensing device 270 on the basis of a circuit part 725.

The length and width of teeth of the dielectric passage 271 increase from the bottom to the top of the water level sensing device 270 on the basis of the circuit part 275. Similarly, the width and length of the teeth of the two electrodes 273 and 277 may increase proportionally to the water level.

Figure 8:
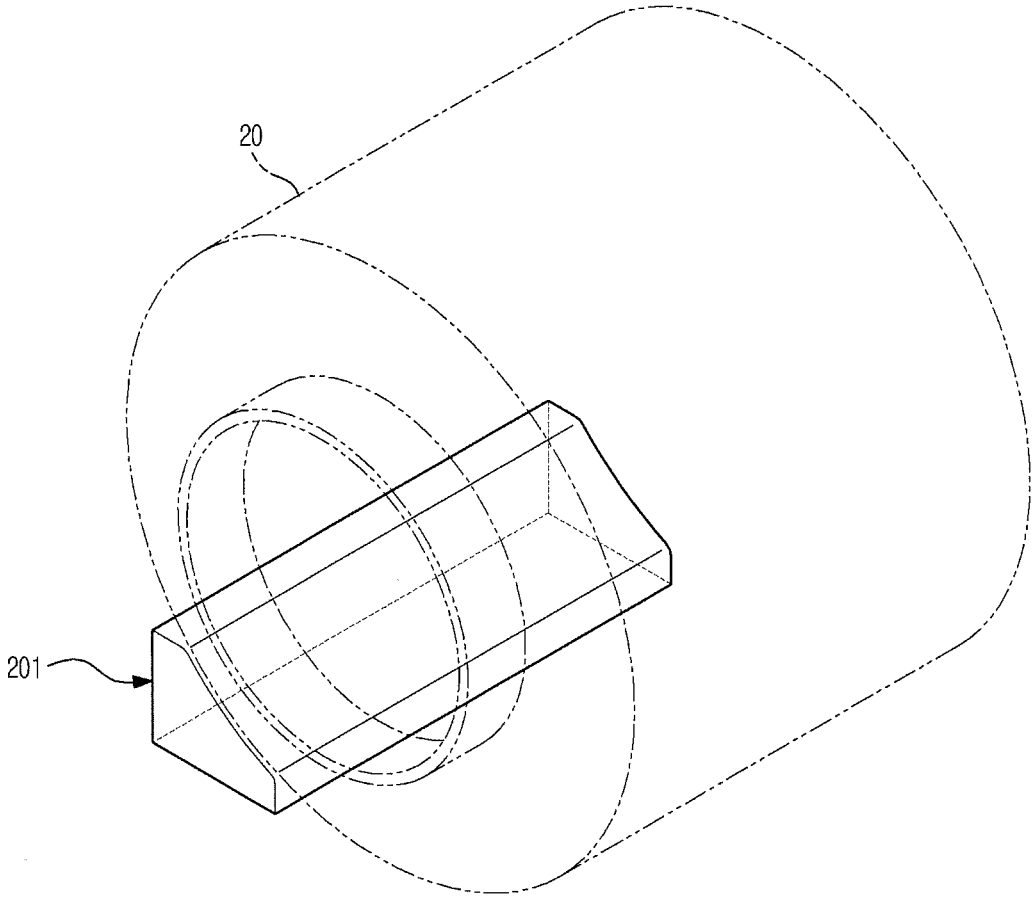
FIG. 8 is a perspective view illustrating a condensate water storage container in accordance with another embodiment.

FIG. 8 is a perspective view illustrating the configuration of a condensate water storage container in accordance with another embodiment.

The condensate water storage container 201 of the present embodiment may have a width decreasing from the bottom to the top of a longitudinal cross section. For example, the condensate water storage container 201 may have a triangular, trapezoidal, or upwardly convex semi-circular longitudinal cross section. With this configuration, when the water level sensing device is used to detect the level of condensate water stored in the storage container 201, it may be possible to accurately detect the change rate of a small amount of condensate water at a high water level, regardless of the configuration of the water level sensing device.

The condensate water storage container 201 may be installed in a position of the dryer 1. FIG. 8 illustrates the storage container 201 as being located at a lateral position of a lower end of the rotary drum 20 in consideration of a limited interior volume of the dryer 1.

In another embodiment, the condensate water is primarily collected in a condensate water collector 73 defined in the base assembly 70. The condensate water of the condensate water collector 73 is pumped by a pump 81 to be guided into the condensate water storage container 200 through the condensate water discharge pipe 82. In this way, the condensate water is stored in the condensate water storage container 200. The water level sensing device 240, 250, 260 or 270 may be provided in the condensate water collector 73 to detect the level of condensate water. Based on the detected level of condensate water, the change rate of condensate water may be detected in real time and also, it is determined whether the condensate water collector 73 is full of the condensate water.

Hereinafter, a drying stroke will be described. Once the drying stroke begins or operation (500), the drive motor 31 and heater 42 are operated. The circulating fan 43 is rotated by the drive motor 31 to generate flow of air, and the heater 42 heats the air passing through the heating duct 41. The air heated in the heating duct 41 is introduced into the rotary drum 20 through the hot air inlet grill 22, thereby acting to dry the drying object received in the rotary drum 20 by removing moisture from the drying object. The high-temperature humid air inside the rotary drum 20 is guided into the condensing unit 50 through the hot air discharge duct 44 and connecting duct 45. The air guided into the condensing unit 50 is cooled and is deprived of moisture contained therein while passing through the condensing flow-paths 51*a* of the condensing unit 50. Then, the resulting air is guided into the heating duct 41 through the hot air circulating flow-path 46 and is reheated by the heater 42 to be resupplied into the rotary drum 20.

The power of the drive motor 31 is also transmitted to the rotary drum 20 via the belt 33 to rotate the rotary drum 20. As the drying object is moved via rotation of the rotary drum 20, uniform drying of the drying object may be possible.

The drive motor 31 also rotates the cooling fan 63. With rotation of the cooling fan 63, outside air is suctioned into the main body 10 through the intake grill 17 and subsequently, is guided into the condensing unit 50 through the flow-paths 61 and 62 defined in the base assembly 70. The relatively cold outside air guided into the condensing unit 50 acts to cool the hot air passing through the condensing flow-paths 51*a* of the condensing unit 50 while passing through the cooling flow-paths 51*b* of the condensing unit 50. The used air is discharged to the outside through an exhaust grill (not shown) provided at the main body 10.

The condensate water generated in the above described drying stroke is collected in the condensate water collector 73 of the base assembly 70. The condensate water of the condensate water collector 73 is pumped by the pump 81 to be guided into the condensate water storage container 200 through the condensate water discharge pipe 82. In this way, the condensate water is stored in the condensate water storage container 200.

Figure 9:
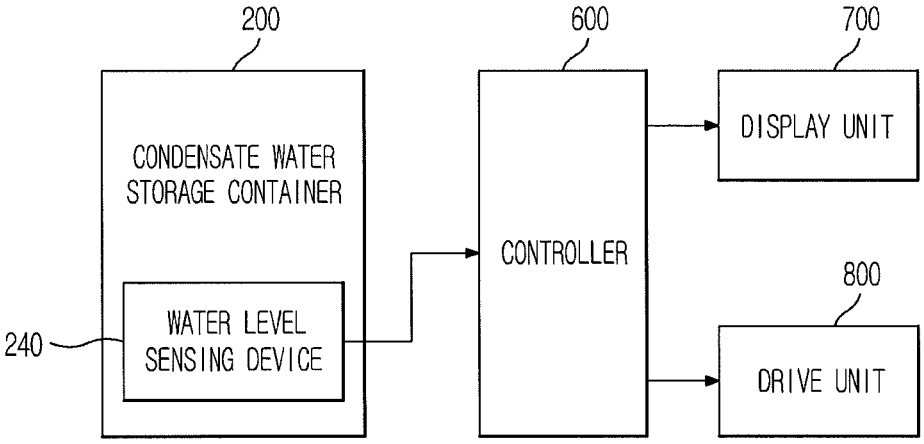
FIG. 9 is a block diagram illustrating an exemplary configuration of the dryer.
Figure 10:
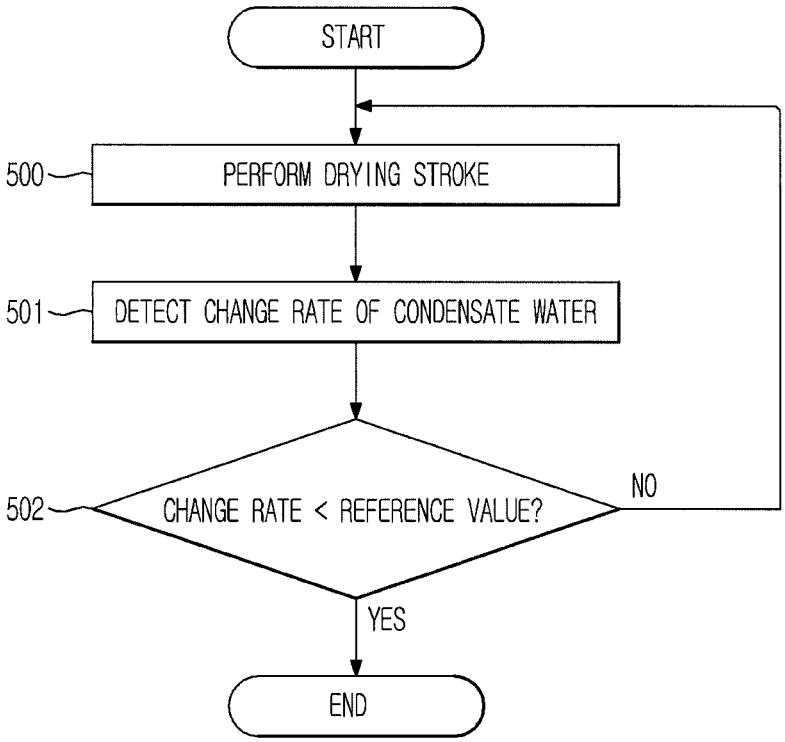
FIG. 10 is a flow chart illustrating a drying operation of the dryer in accordance with one embodiment.

The remaining drying stroke after the condensate water is stored in the storage container 200 will be described with reference to the block diagram of FIG. 9 that illustrates an exemplary configuration of the dryer and the flow chart of FIG. 10 that illustrates the sequence of the drying stroke.

The water level sensing device 240 located in the condensate water collector 73 or the condensate water storage container 200 detects the level of condensate water, and transmits the water level value to a controller 600. The controller may be a microcomputer. During the drying operation (501), the controller 600 calculates the change rate of condensate water on a per unit time basis based on the water level value (501). Next, the controller 600 determines whether to complete the drying stroke by comparing the change rate of condensate water with a reference value.

The controller 600 commands to repeat the drying stroke if the change rate is greater than the reference value, and to end the drying stroke if the change rate is smaller than the reference value (502).

Figure 11:
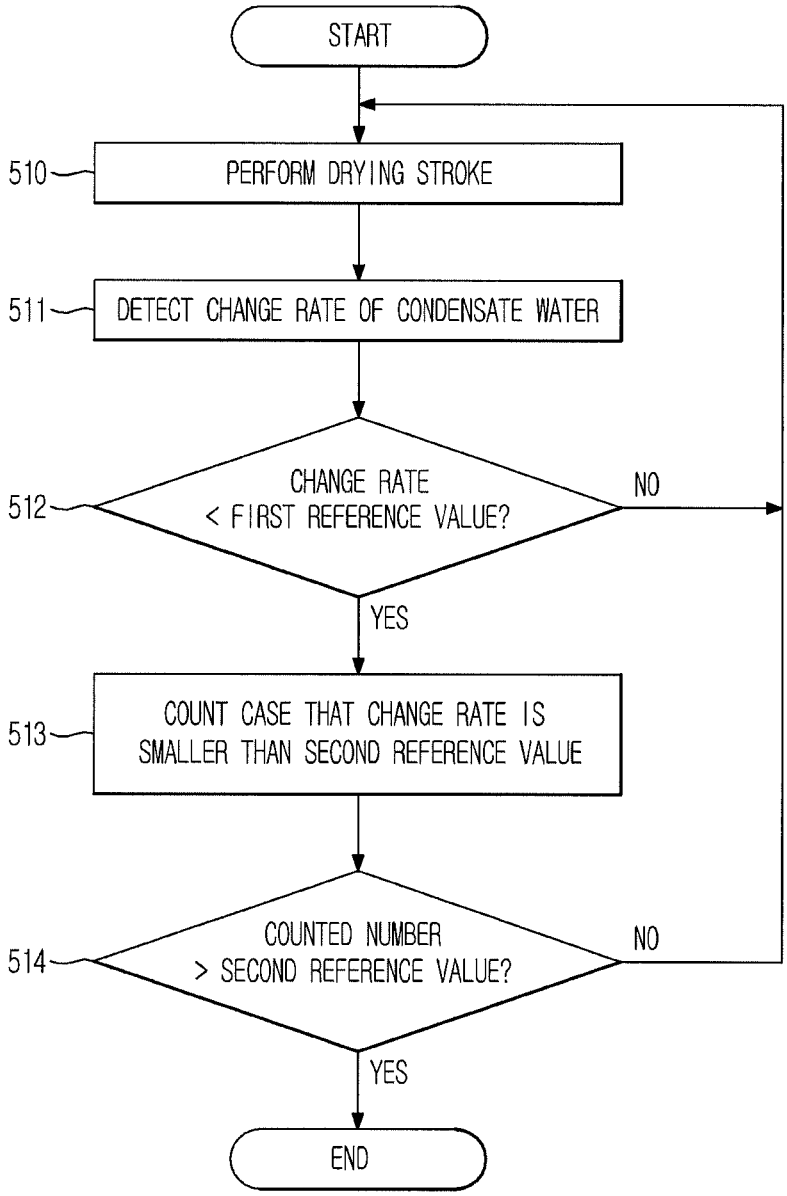
FIG. 11 is a flow chart illustrating a drying operation of the dryer in accordance with another embodiment.

To accurately determine whether or not to complete the drying stroke (510), a control method of FIG. 11 may be performed. The controller 600 calculates the change rate of condensation or of condensate water level on a per unit time basis based on the water level value (511). Then, the controller 600 compares the change rate of condensate water level with a first reference value, to repeat the drying stroke if the change rate is greater than the first reference value and to proceed a following counting operation if the change rate is smaller than the first reference value for more accurate detection of the value of dryness (512). That is, if the change rate is smaller than a first reference value, the controller 600 counts the case that the change rate is smaller than the reference value (513). The controller 600 commands to repeat the drying stroke if the counted number is smaller than a second reference value, and to end the drying stroke if the counted number is greater than the second reference value.

The controller 600 transmits a signal representing the value of dryness and a signal informing of whether or not to complete the drying stroke to a display unit 700 and a drive unit 800. The display unit 700 visually informs a user of the value of dryness and whether or not to complete the drying stroke. The drive unit 800 is driven to selectively operate the dryer according to the signals transmitted from the controller 600.

As described above, the embodiments have a basic feature in that the change rate of condensate water stored in the condensate water storage container is used to determine the value of dryness of the drying object and consequently, to determine whether or not to complete the drying stroke. Moreover, in consideration of the fact that the change rate of condensate water decreases after the drying of the object is performed to some extent, the embodiments may employ a structure to more precisely detect the change rate of condensate water as the change rate decreases and as the water level increases.

As is apparent from the above description, in accordance with an aspect, the level of condensate water in a condensate water storage container is detected to calculate the change rate of condensate water and in turn, the value of dryness of a drying object may be more accurately detected based on the change rate of condensate water.

In accordance with another aspect, in consideration of the fact that the amount of water removed from a drying object, i.e. the amount of condensate water decreases when a drying stroke is almost completed, a water level sensing device may have higher accuracy with respect to a high water level to more effectively detect the change rate of condensate water at the high water level. That is, the value of dryness of the drying object may be more accurately detected with the approach of the completion of the drying stroke, to inform a user of completion of the drying stroke.

In accordance with another aspect, the condensate water storage container may be configured such that the width of a longitudinal cross section decreases from the bottom to the top thereof. With this configuration, it may be possible to accurately detect the change rate of condensate water at a high water level, and consequently, to more accurately detect the value of dryness of the drying object in proportion to the progress of the drying stroke. In addition, since the high detection accuracy effects may be obtained without using an expensive high accuracy sensing device, advantageous effects in terms of costs may be obtained.

In accordance with a further aspect, as the water level sensing device is located in a condensate water collector in which condensate water is preliminarily collected prior to being stored in the condensate water storage container, the change rate of condensate water may be detected in real time, and the water level sensing device may also be utilized to control a pumping operation to move the condensate water into the condensate water storage container.

Although a few embodiments have been shown and described, it would be appreciated by those skilled in the art that changes may be made in these embodiments without departing from the principles and spirit of the embodiment, the scope of which is defined in the claims and their equivalents.

What is claimed is:

1. A dryer, comprising:

a condensing unit to change water vapor evaporated from a drying object into condensate water by cooling;

a condensate water storage container in which the condensate water is stored;

a water level sensing device to detect a level of the stored condensate water; and a controller to calculate a change rate of the condensate water based on the detected water level and to determine a value of dryness of the drying object.

2. The dryer according to claim 1, wherein the condensate water storage container has a cross sectional width decreasing from the bottom to the top thereof.

3. The dryer according to claim 1, wherein the water level sensing device includes a plurality of electrodes having opposite polarities, and detects the level of condensate water based on a permittivity change between the electrodes.

4. The dryer according to claim 3, wherein a contact area between the plurality of electrodes and the condensate water increases from the bottom to the top of the condensate water storage container.

5. The dryer according to claim 4, wherein the plurality of electrodes has toothed facing surfaces and is arranged close to each other such that the toothed surfaces of the electrodes correspond to each other, and a length of teeth of the toothed surfaces decreases from the bottom to the top of the storage container.

6. The dryer according to claim 4, wherein a width of the teeth of the toothed surfaces increases from the bottom to the top of the storage container.

7. The dryer according to claim 6, wherein a length of the teeth of the toothed surfaces decreases from the bottom to the top of the storage container.

8. The dryer according to claim 7, wherein the condensate water storage container has a cross sectional width decreasing from the bottom to the top thereof.

9. A dryer, comprising:

a condensing unit to change water vapor evaporated from a drying object into condensate water by cooling;

a condensate water collector in which the condensate water is collected;

a condensate water storage container in which the condensate water is stored;

a pump to move the condensate water collected in the condensate water collector to the condensate water storage container;

a water level sensing device to detect a level of the condensate water in the condensate water collector; and a controller to calculate a change rate of the condensate water based on the detected water level and to determine a value of dryness of the drying object.

10. The dryer according to claim 9, wherein the condensate water collector has a cross sectional width decreasing from the bottom to the top thereof.

11. The dryer according to claim 9, wherein the water level sensing device includes a plurality of electrodes having opposite polarities, and detects the level of condensate water based on a permittivity change between the electrodes.

12. The dryer according to claim 11, wherein a contact area between the plurality of electrodes and the condensate water increases from the bottom to the top of the condensate water collector.

13. The dryer according to claim 12, wherein the plurality of electrodes has toothed facing surfaces and is arranged close to each other such that the toothed surfaces of the electrodes correspond to each other, and a length of teeth of the toothed surfaces decreases from the bottom to the top of the condensate water collector.

14. The dryer according to claim 12, wherein a width of the teeth of the toothed surfaces increases from the bottom to the top of the condensate water collector.

15. The dryer according to claim 14, wherein a length of the teeth of the toothed surfaces decreases from the bottom to the top of the condensate water collector.

16. The dryer according to claim 15, wherein the condensate water collector has a cross sectional width decreasing from the bottom to the top thereof.

17. A dryer control method, comprising:

detecting a level of condensate water;

calculating a change rate of condensate water based on the detected level of condensate water; and detecting a value of dryness of a drying object based on the change rate, wherein detecting the level of condensate water is based upon a voltage change of electrodes.

18. The dryer control method according to claim 17, further comprising comparing the change rate with a first reference value, to repeat a drying stroke if the change rate is greater than the first reference value and to end the drying stroke if the change rate is smaller than the first reference value.

19. The dryer control method according to claim 18, further comprising:

counting a case that the change rate is smaller than a second reference value if the change rate is smaller than the second reference value;

repeating the drying stroke if the counted number is smaller than the second reference value; and ending the drying stroke if the counted number is greater than the second reference value.

* * * * *